US009243531B2

(12) United States Patent
Tsumagari et al.

(10) Patent No.: US 9,243,531 B2
(45) Date of Patent: Jan. 26, 2016

(54) BURNER FOR EXHAUST GAS PURIFICATION DEVICES

(71) Applicants: HINO MOTORS, LTD., Hino-shi (JP); SANGO CO., LTD., Aichi-ken (JP)

(72) Inventors: Ichiro Tsumagari, Hino (JP); Ryo Shibuya, Hino (JP); Atsushi Koide, Miyoshi (JP)

(73) Assignee: Hino Motors, Ltd., Tokyo (JP)

( * ) Notice: Subject to any disclaimer, the term of this patent is extended or adjusted under 35 U.S.C. 154(b) by 0 days.

(21) Appl. No.: 14/369,304

(22) PCT Filed: Aug. 7, 2013

(86) PCT No.: PCT/JP2013/071430

§ 371 (c)(1),
(2) Date: Jun. 27, 2014

(87) PCT Pub. No.: WO2014/024943

PCT Pub. Date: Feb. 13, 2014

(65) Prior Publication Data

US 2015/0152761 A1 Jun. 4, 2015

(30) Foreign Application Priority Data

Aug. 7, 2012 (JP) ..... 2012-174930
Aug. 30, 2012 (JP) ..... 2012-190079

(51) Int. Cl.
*F01N 3/10* (2006.01)
*F01N 1/00* (2006.01)
(Continued)

(52) U.S. Cl.
CPC *F01N 3/025* (2013.01); *F01N 3/20* (2013.01); *F23C 6/045* (2013.01); *F23C 7/002* (2013.01);
(Continued)

(58) Field of Classification Search
CPC . F01N 3/025; F01N 2240/14; F01N 2470/18; F01N 2470/24
USPC ..... 60/295, 303, 311, 322
See application file for complete search history.

(56) References Cited

U.S. PATENT DOCUMENTS 1,848,990 A * 3/1932 Boyd et al. ..... 422/174
2,181,261 A 11/1939 Breese
(Continued)

FOREIGN PATENT DOCUMENTS

CN 85200213 9/1985
CN 2238967 10/1996
(Continued)

OTHER PUBLICATIONS

Official Action for China Patent Application No. 201380004670.4, dated Dec. 26, 2014, 5 pages.
(Continued)

*Primary Examiner* — Audrey K Bradley
(74) *Attorney, Agent, or Firm* — Sheridan Ross P.C.

(57) ABSTRACT

A burner for exhaust gas purification devices, comprising a base section, a first pipe section, and a second pipe section. The first pipe section has abase end section, a tip section, a combustion chamber, and a discharge port from which combusted gas is discharged. The base end section and the tip section are fixed to the base section. The second pipe section has a base end section and a tip section, and said base end and tip sections are fixed to the base section. The first pipe section also comprises an expansion/contraction section capable of expanding and contracting in a direction parallel to the central axis. The first pipe section and the second pipe section mutually overlap in the radial direction so as to form a multilayer tube structure.

5 Claims, 5 Drawing Sheets

(51) Int. Cl.

| | |
|---|---|
| ***F01N 3/025*** | (2006.01) |
| ***F01N 3/20*** | (2006.01) |
| ***F23C 6/04*** | (2006.01) |
| ***F23C 7/00*** | (2006.01) |
| ***F23D 11/40*** | (2006.01) |
| ***F23D 11/44*** | (2006.01) |
| ***F23G 7/06*** | (2006.01) |

(52) U.S. Cl.

CPC ..... *F23D 11/40* (2013.01); *F23D 11/402* (2013.01); *F23D 11/404* (2013.01); *F23D 11/406* (2013.01); *F23D 11/443* (2013.01); *F23G 7/066* (2013.01); *F01N 2240/14* (2013.01); *F01N 2240/20* (2013.01); *F01N 2470/24* (2013.01); *F23C 2900/03005* (2013.01); *F23C 2900/06041* (2013.01); *F23D 2209/10* (2013.01); *F23D 2211/00* (2013.01)

(56) References Cited

U.S. PATENT DOCUMENTS

| | | | | |
|---|---|---|---|---|
| 2,458,066 | A | 1/1949 | Farkas et al. | |
| 2,918,117 | A | 12/1959 | Griffin | |
| 2,946,651 | A | 7/1960 | Houdry | |
| 3,083,525 | A * | 4/1963 | Morris | 60/300 |
| 2,806,517 | A | 9/1967 | Te Nuyl | |
| 4,030,875 | A | 6/1977 | Grondahl et al. | |
| 4,538,413 | A | 9/1985 | Shinzawa et al. | |
| 4,565,380 | A | 1/1986 | Newman et al. | |
| 4,716,725 | A | 1/1988 | Dettling et al. | |
| 4,952,218 | A | 8/1990 | Lipp et al. | |
| 4,982,570 | A | 1/1991 | Waslo et al. | |
| 5,105,621 | A | 4/1992 | Simmons et al. | |
| 5,293,743 | A | 3/1994 | Usleman et al. | |
| 5,339,630 | A | 8/1994 | Pettit | |
| 5,370,526 | A | 12/1994 | Buschulte et al. | |
| 5,450,869 | A | 9/1995 | Brittain et al. | |
| 5,993,197 | A | 11/1999 | Alber et al. | |
| 6,131,960 | A | 10/2000 | McHughs | |
| 7,685,811 | B2 | 3/2010 | Taylor et al. | |
| 9,027,332 | B2 | 5/2015 | Olivier | |
| 2002/0136997 | A1 | 9/2002 | Wolf et al. | |
| 2003/0022123 | A1 | 1/2003 | Wolf | |
| 2003/0159445 | A1 | 8/2003 | Farmer et al. | |
| 2006/0130469 | A1 * | 6/2006 | Baeuerle et al. | 60/300 |
| 2009/0158720 | A1 | 6/2009 | Krause et al. | |
| 2011/0061369 | A1 | 3/2011 | Yetkin et al. | |
| 2012/0322012 | A1 | 12/2012 | Tsumagari et al. | |

FOREIGN PATENT DOCUMENTS

| | | | |
|---|---|---|---|
| CN | 1040861 | | 3/1999 |
| CN | 1441198 | | 9/2003 |
| CN | 102159890 | | 8/2011 |
| CN | 202024329 | | 11/2011 |
| DE | 4440716 | | 7/1996 |
| DE | 202010005022 | | 7/2010 |
| EP | 0031279 | | 7/1981 |
| EP | 2075426 | | 7/2009 |
| FR | 2438234 | | 4/1980 |
| FR | 2540974 | | 8/1984 |
| GB | 2035538 | | 6/1980 |
| JP | 58-160726 | A | 9/1983 |
| JP | 59-54707 | U | 4/1984 |
| JP | 59-93913 | A | 5/1984 |
| JP | 60-58810 | U | 4/1985 |
| JP | 60-162213 | U | 10/1985 |
| JP | 61-29010 | U | 2/1986 |
| JP | 61-280305 | A | 12/1986 |
| JP | 4-350315 | A | 12/1992 |
| JP | 6-84118 | U | 12/1994 |
| JP | 2003-49636 | A | 2/2003 |
| JP | 2009-41852 | A | 2/2009 |
| JP | 4393858 | B2 | 10/2009 |
| JP | 2011-157824 | A | 8/2011 |
| JP | 2011-185493 | A | 9/2011 |
| WO | WO 2011-034884 | A1 | 3/2011 |

OTHER PUBLICATIONS

International Search Report prepared by the Japanese Patent Office on Nov. 12, 2013, for International Application No. PCT/JP2013/071430.

Official Action for China Patent Application No. 201380011673.0, dated Mar. 19, 2015, 5 pages.

Official Action for Australia Patent Application No. 2013300488, mailed Mar. 3, 2015, 3 pages.

Partial Search Report for European Patent Application No. 13828197.7, dated Jun. 26, 2015, 7 pages.

Partial Search Report for European Patent Application No. 13828740.4, dated Jun. 29, 2015, 7 pages.

* cited by examiner

BURNER FOR EXHAUST GAS PURIFICATION DEVICES

CROSS-REFERENCE TO RELATED APPLICATIONS

This application is a national stage application under 35 U.S.C. 371 and claims the benefit of PCT Application No. PCT/JP2013/071430 filed 7 Aug. 2013, which designated the United States, which PCT Application claimed the benefit of Japanese Patent Application No. 2012-174930 filed 7 Aug. 2012, and Japanese Patent Application No. 2012-190079 filed 30 Aug., 2012, the disclosure of each of which are incorporated herein by reference.

FIELD OF THE INVENTION

The present invention relates to a burner for an exhaust gas purification device, which is used in an exhaust gas purification device for purifying an exhaust gas from an internal combustion engine (hereinafter referred to as an engine) and raises the temperature of the exhaust gas.

BACKGROUND OF THE INVENTION

Conventional diesel engines include an exhaust gas purification device arranged in the exhaust passage. The exhaust gas purification device includes a diesel particulate filter (DPF), which captures particulates contained in an exhaust gas, and an oxidation catalyst. Such an exhaust gas purification device treats an exhaust gas to raise the temperature in order to maintain the function of purifying an exhaust gas. The treatment regenerates the DPF by burning the particulates captured by the DPF and activates the oxidation catalyst. A burner that performs the treatment for raising the temperature of the exhaust gas is arranged upstream of the DPF and the oxidation catalyst.

One example of the structure of the burner is a multilayer tube structure. In the multilayer tube structure, a plurality of tubular members is overlapped to be coaxial. For example, Patent Document 1 discloses a combustor including a combustion tube, in which a flame is generated. The combustion tube includes an inner tube and an outer tube. An auxiliary combustion tube is arranged radially inside of the inner tube. The inner tube and the outer tube are fixed to a base. Fuel injected into the auxiliary combustion tube is mixed and evaporated in a premixing region. A flame occurs in a combustion chamber by igniting a premixed air-fuel mixture. Combustion is promoted by supplying air for combustion through combustion holes of the outer tube.

PRIOR ART DOCUMENT

Patent Document

Patent Document 1: Japanese Laid-Open Patent Publication 58-160726

SUMMARY OF THE INVENTION

The inner tube includes a head portion in which aflame occurs, and is heated to a high temperature. Due to the heat, the inner tube expands mostly in the direction parallel to the central axis. The auxiliary combustion tube includes the premixing region and therefore has a lower temperature than the inner tube. The outer tube includes an airflow path for supplying air to the combustion holes and also has a lower temperature than the inner tube. Thus, during combustion, the expansion amount of the inner tube is greater than the expansion amounts of the auxiliary combustion tube and the outer tube.

For this reason, in the burner having the multilayer tube structure, a difference occurs in the expansion amount between a tube exposed to a high temperature and a tube kept at a relatively low temperature during the combustion. When the inner tube has the distal end joined to the inner surface of the outer tube, or when the auxiliary combustion tube has the distal end joined to the inner tube, a great stress acts on a joining portion between the tubes due to the difference in the thermal expansion amount between the tubes. When the burner is repeatedly ignited, a stress acts on the joining portion each time. This may cause fatigue cracks on any of the tubular members.

It is an objective of the present invention to provide a burner for an exhaust gas purification device that prevents damage on tubes that results from a difference in the expansion amount between the tubes.

In accordance with one aspect of the present disclosure, a burner for an exhaust gas purification device comprises abase unit, a first tube, and a second tube. The first tube includes a basal portion and a distal portion, a combustion chamber, and a discharge port for discharging a post-combustion gas. The basal portion and the distal portion are fixed to the base unit. The second tube includes a basal portion and a distal portion, and the basal portion and the distal portion are fixed to the base unit. The first tube further includes an extendable portion that can be extended and contracted in a direction parallel to a central axis of the first tube when being pressed in the direction. The first tube and the second tube are radially overlapped to have a multilayer tube structure.

According to the present aspect, the first tube including the combustion chamber has a greater expansion amount than the second tube. Since both opposite ends of the first and second tubes are fixed to the base unit, a difference in the expansion amount between these tubes becomes a factor to cause damage unless cancelled. According to the present aspect, the extendable portion of the first tube absorbs the difference in the expansion amount. This reduces stress applied to each tube during combustion and reduces damage on its joining portion or the tube from fatigue cracks and the like.

In one embodiment, the burner for an exhaust gas purification device further comprises a premixing chamber, which is arranged upstream of the combustion chamber and configured to supply a premixed air-fuel mixture, in which air for combustion and fuel are mixed, to the combustion chamber. The extendable portion does not form the combustion chamber but forms apart of the premixing chamber.

In this case, where the extendable portion is not directly exposed to a post-combustion gas, the material and the shape of the extendable portion do not have to have a high heat resistance. Furthermore, when the extendable portion forms the combustion chamber, even if the wall includes a hole to supply air for combustion, the inner diameter of the hole is changed by contraction. In the present embodiment, the flexibility in design of the combustion chamber is maintained compared to when the extendable portion forms the combustion chamber.

In one embodiment, at least one of the first tube and the second tube further includes a swirling flow generating portion, and the extendable portion includes a circumferential wall, which extends in the swirling direction of a swirling flow and is bellows-shaped.

In this case, since at least one of the first tube and the second tube includes the swirling flow generating portion, swirling of air for combustion is promoted. Moreover, since the extendable portion includes the circumferential wall, which extends in the swirling direction of the swirling flow and is bellows-shaped, the swirling flow strikes the pleated circumferential wall to generate turbulence. This promotes mixture of fuel and air for combustion.

In one embodiment, the basal portion of the first tube includes a swirling flow generating portion for generating a swirling flow in the first tube. The first tube further includes a head portion having the combustion chamber inside. The extendable portion is arranged between the basal portion and the head portion.

In this case, the swirling flow generated by the swirling flow generating portion of the basal portion is supplied to the extendable portion. The swirling flow strikes the circumferential wall to generate turbulence in the flow. The turbulence promotes mixture of fuel and air for combustion. The extendable portion also absorbs the axial extension amount of the head portion, which results from thermal expansion.

In one embodiment, the first tube further includes a head portion having the combustion chamber inside. The extendable portion is joined to the head portion. The head portion and the extendable portion are shaped cylindrical. The extendable portion is joined to the head portion such that the extension direction of the extendable portion is parallel to a circumferential wall of the head portion.

In this case, the head portion and the extendable portion are cylindrical, and the circumferential wall of the head portion is parallel to the extension direction of the extendable portion. For this reason, the direction in which the head portion extends with thermal expansion is the same as the extension direction. This minimizes stress applied to the first tube, for example, compared to when the head portion of the first tube are conical.

In one embodiment, the second tube is located radially outside of the first tube, and a passage for air for combustion is formed between the first tube and the second tube. The burner for an exhaust gas purification device further comprises a first connecting tube portion and a second connecting tube portion. The first connecting tube portion is connected to an inner circumferential surface of the first tube and includes an opening at an end closer to the discharge port. The second connecting tube portion includes a lid portion and compartmentalizes the combustion chamber from a premixing chamber. The second connecting tube includes a supply hole connected to the combustion chamber. The first connecting tube portion is inserted in the second connecting tube portion while being spaced from the second connecting tube portion. The extendable portion is formed in a part of a circumferential wall of the first tube and is arranged between the first connecting tube portion and the second connecting tube portion.

In this case, air for combustion flows into the first tube with fuel through the flow path between the first tube and the second tube. A premixed air-fuel mixture, in which the air for combustion and the fuel are mixed, passes through the first connecting tube and flows into the second connecting tube through the opening of the first connecting tube. Further, the premixed air-fuel mixture passes between the first connecting tube and the second connecting tube having the lid portion, and is supplied to the combustion chamber through the supply hole of the second connecting tube. In this way, the premixed air-fuel mixture having a longer flow path promotes mixture of the fuel and the air for combustion. In addition, the extendable portion is arranged between a first inside tube and a second inside tube, and absorbs expansion of the tubes exposed to a post-combustion gas in the combustion chamber.

MODES FOR CARRYING OUT THE INVENTION

Detailed Description of the Preferred Embodiments

First Embodiment

A burner for an exhaust gas purification device according to a first embodiment of the present invention will now be described with reference to FIG. 1 to FIG. 4.

Figure 1:
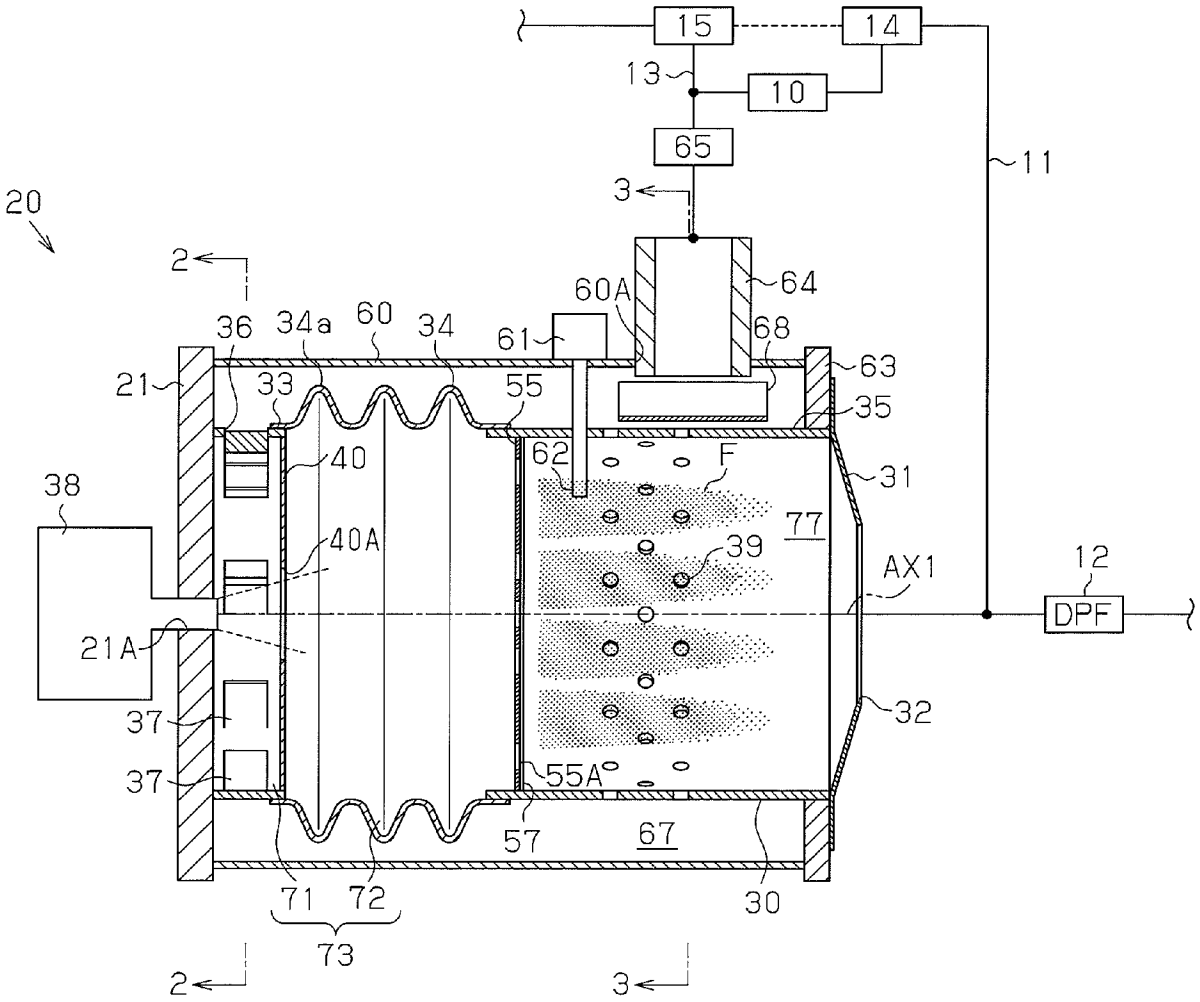
FIG. 1 is a schematic view of a burner for an exhaust gas purification device according to a first embodiment of the present invention.

As shown in FIG. 1, a diesel engine 10 includes, in an exhaust passage 11, a DPF 12, which captures particulates contained in an exhaust gas. The DPF 12 has a honeycomb structure made of, for example, a porous silicon carbide and captures particulates in the exhaust gas. A burner for an exhaust gas purification device 20 (hereinafter, simply referred to as a burner 20) is arranged upstream of the DPF 12. The burner 20 carries out a regeneration process of the DPF 12 by raising the temperature of an exhaust gas flowing into the DPF 12.

The burner 20 has a dual tube structure including a substantially cylindrical inner tube 30 and an outer tube 60 having an inner diameter greater than the diameter of the inner tube 30. The inner tube 30 includes openings at opposite ends in the direction parallel to the central axis AX1 (hereinafter, the axial direction). The inner tube 30 includes a basal portion 33 as a first end portion in the axial direction or a bottom portion, an extendable portion 34, and a head portion 35 as a second end portion in the axial direction. The bottom of the inner tube 30 is fixed to a basal-side base 21, which closes the opening of the bottom portion. The head portion 35 of the inner tube 30 includes a substantially annular ejection plate 31 arranged at the opening. The ejection plate 31 includes an ejection port 32 as a discharge port extending through the center.

The basal portion 33, the extendable portion 34, and the head portion 35 are made from the same metallic material. The ends of the extendable portion 34 in the axial direction are respectively fixed to the outer circumferential surfaces of the basal portion 33 and the head portion 35 by welding and the like.

Figure 2:
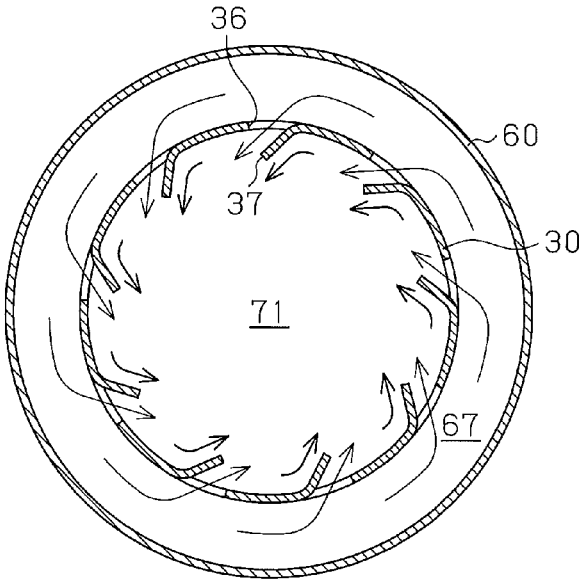
FIG. 2 is a cross-sectional view taken along line 2-2 in FIG. 1.

The basal portion 33 includes raised pieces 37, which form a swirling flow generating portion. As shown in FIG. 2, the raised pieces 37 are formed by cutting and raising parts of the circumferential wall of the basal portion 33 radially inward. The raised pieces 37 are arranged at equal intervals in the circumferential direction of the basal portion 33. The interior of the inner tube 30 is connected to the exterior through first introduction holes 36 formed by forming raised pieces 37.

As shown in FIG. 1, the extendable portion 34 is substantially cylindrical, and the circumferential wall is bellows-shaped. In the present embodiment, the circumferential wall includes a plurality of raised portions 34*a*, which has the largest inner diameter. The extendable portion 34 is formed with a thinner wall than the basal portion 33. That is, the circumferential wall of the extendable portion 34 has a smaller thickness than the circumferential wall of the basal portion 33. For this reason, the extendable portion 34 can be extended and contracted in the axial direction.

The opening of the head portion 35 is fixed to the ejection plate 31. The head portion 35 fits into the head-side base 63 at the distal end. The basal-side base 21 and the head-side base 63 form a base unit. The head portion 35 includes a plurality of second introduction holes 39 extending through the circumferential wall in the substantially central area. The second introduction holes 39 are shaped circular and formed at equal intervals in the circumferential direction of the head portion 35.

As shown in FIG. 1, the basal-side base 21 includes a fuel supply port 21A at the substantially center to fix the injection port of a fuel supply unit 38. The fuel supply unit 38 is connected to a fuel pump and a fuel valve (neither is shown). Opening the fuel valve delivers fuel to the fuel supply unit 38. The delivered fuel is vaporized in the fuel supply unit 38 and injected into the inner tube 30.

As shown in FIG. 1, the inner tube 30 includes an orifice plate 40 closer to the ejection port 32 than the raised pieces 37. The orifice plate 40 includes an orifice hole 40A extending through the center. The orifice plate 40, the basal-side base 21, and the basal portion of the inner tube 30 define a first mixing chamber 71.

As shown in FIG. 1, the inner tube 30 includes a burner head 55 between the orifice plate 40 and the second introduction holes 39. The burner head 55 is disk-shaped with the diameter substantially same as the inner diameter of the inner tube 30, and has the outer circumferential edge joined to the inner circumferential surface of the inner tube 30.

Figure 3:
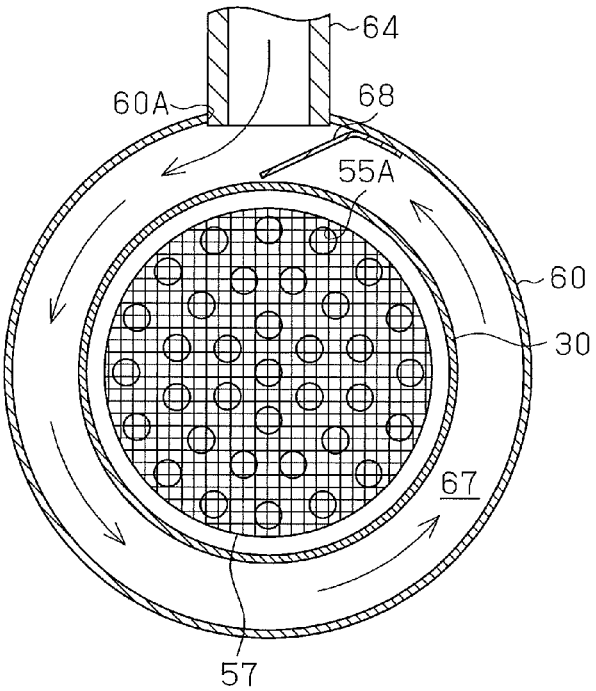
FIG. 3 is a cross-sectional view taken along line 3-3 in FIG. 1.

As shown in FIG. 3, a large number of circular supply holes 55A extend through the burner head 55 in the thickness direction. The burner head 55 includes a metal mesh 57 on the lateral face closer to the ejection port 32 in order to avoid backfire.

As shown in FIG. 1, the burner head 55, the inner circumferential surface of the inner tube 30, and the orifice plate 40 define a second mixing chamber 72. The second mixing chamber 72 is connected to the first mixing chamber 71 through the orifice hole 40A. The first mixing chamber 71 and the second mixing chamber 72 form a premixing chamber 73 for mixing fuel with air for combustion.

The burner head 55, the head portion 35, and the ejection plate 31 form a combustion chamber 77 for generating a flame F. The combustion chamber 77 is connected to the second mixing chamber 72 through the supply holes 55A formed on the burner head 55, and connected to the DPF 12 through the ejection port 32. The combustion chamber 77 includes an insertion hole extending through the head portion 35 at the position closer to the burner head 55 than the area where the second introduction holes 39 are formed. The ignition portion 62 of a spark plug 61 is inserted into the insertion hole. The diameter of the insertion hole is slightly larger than the outer diameter of the ignition portion 62.

As shown in FIG. 1, the outer tube 60 is fixed to the basal-side base 21 to be coaxial with the inner tube 30, and has the opening of the bottom portion closed by the basal-side base 21. The space between the inner surface of the outer tube 60 closer to the opening of the head portion and the outer circumferential surface of the inner tube 30 is closed by the head-side base 63. That is, the inner tube 30 and the outer tube 60 have the basal ends fixed to the basal-side base 21 and the distal ends fixed to the head-side base 63.

The outer tube 60 includes an air supply port 60A arranged closer to the opening of the head portion. The air supply port 60A is fixed to the inlet of an air supply passage 64. The outer tube 60 includes the air supply port 60A in the same area as where the second introduction holes 39 are formed in the inner tube 30 or in the area closer to the opening of the head portion than the second introduction holes 39. As shown in FIG. 3, a guide plate 68 is provided on the inner circumferential surface of the outer tube 60, near the opening of the air supply port 60A. The guide plate 68 is fixed to the outer tube 60 in a cantilever-like manner in a state that the lateral face of the guide plate 68 is inclined in the direction along the inner circumferential surface of the outer tube 60. The guide plate 68 is inclined in the same direction as the raised pieces 37 on the inner tube 30.

As shown in FIG. 1, the upstream end of the air supply passage 64 is arranged at the intake passage 13 of the engine 10 and is connected to downstream of a compressor 15, which rotates with a turbine 14 arranged in the exhaust passage 11.

The air supply passage 64 further includes an air valve 65 capable of changing the flow path cross-sectional area of the air supply passage 64. Opening and closing of the air valve 65 is controlled by a control unit, not shown. When the air valve 65 is in an open state, some intake air flowing through the intake passage 13 is introduced into the outer tube 60 from the air supply passage 64.

A distribution chamber 67 is provided between the inner circumferential surface of the outer tube 60 and the outer circumferential surface of the inner tube 30. The distribution chamber 67 distributes air for combustion to the first mixing chamber 71 and the combustion chamber 77. In the present embodiment, the inner tube 30 and the outer tube 60, which function as the distribution chamber 67 of an airflow path, need to be closed by the basal-side base 21 and the head-side base 63.

As shown in FIG. 3, the distribution chamber 67 is shaped annular to surround the inner tube 30. That is, the distribution chamber 67 is connected to the first mixing chamber 71 through the first introduction holes 36 arranged in the basal portion of the inner tube 30, and connected to the combustion chamber 77 through the second introduction holes 39 formed in the substantially central area of the inner tube 30.

Operation of the burner 20 in the first embodiment will now be described. When a regeneration process of the DPF 12 starts, the air valve 65 is controlled to be in the open state, and the fuel supply unit 38 and the spark plug 61 are activated. The air valve 65 in the open state introduces some intake air flowing through the intake passage 13 to the distribution chamber 67 as air for combustion of the burner 20 from the air supply passage 64 through the air supply port 60A. As shown in FIG. 3, when the air for combustion strikes the guide plate 68, the air for combustion is blocked from flowing against the inclined direction of the guide plate 68. As shown by the arrows in FIG. 3, the air for combustion keeps swirling in a predetermined direction and flows in the opposite direction toward the ejection port 32.

Some of the air for combustion introduced to the distribution chamber 67 is introduced to the combustion chamber 77 through the second introduction holes 39. As shown in FIG. 2, the remaining portion of the air for combustion is introduced to the first mixing chamber 71 through the first introduction holes 36. As described above, since the guide plate 68 and the raised pieces 37 are inclined in the same direction, the air for combustion does not lose the momentum of swirling. Rather, the air for combustion gains momentum of swirling and is introduced to the first mixing chamber 71.

The swirling flow generated by the raised pieces 37 flows toward the orifice hole 40A while converging to the radially-central part of the inner tube 30, which is a region to which the fuel supply unit 38 supplies fuel. The fuel is caught in the swirling flow and spreads outward from the center of the swirling flow.

The premixed air-fuel mixture, in which air for combustion and fuel are mixed, keeps a swirling flow in a predetermined direction and is discharged to the second mixing chamber 72 while forming a contracted flow through the outlet of the orifice hole 40A. The downstream pressure of the orifice hole 40A is reduced less than the upstream pressure. The mixed air-fuel mixture, which gained force by forming the contracted flow, spreads throughout the second mixing chamber 72 while swirling.

In the second mixing chamber 72, some of the swirling flow flows toward the supply holes 55A while striking the bellows-shaped circumferential wall. As a result, turbulence occurs in the premixed air-fuel mixture in the second mixing chamber 72, and this allows homogenizing the fuel concentration distribution in the premixed air-fuel mixture.

In this way, the premixed air-fuel mixture mixed in the second mixing chamber 72 is introduced to the combustion chamber 77 through the supply holes 55A of the burner head 55. When the ignition portion 62 ignites the premixed air-fuel mixture flowing into the combustion chamber 77, a flame F occurs in the combustion chamber 77 to combust the premixed air-fuel mixture. At this time, as shown in FIG. 1, air for combustion is supplied to near and downstream of the ignition portion 62 from the distribution chamber 67 through the second introduction holes 39. As a result, air for combustion is constantly supplied to the flame F to promote combustion.

A post-combustion gas generated in the combustion chamber 77 is supplied to the exhaust passage 11 through the ejection port 32 and is mixed with an exhaust gas in the exhaust passage 11 to raise the temperature of an exhaust gas flowing into the DPF 12. As a result, the particulates captured by the DPF 12 are burnt.

When a premixed air-fuel mixture is combusted in the combustion chamber 77, the post-combustion gas at a high temperature heats the head portion 35. For this reason, after combustion starts, the temperature of air for combustion flowing in the distribution chamber 67 is raised by heat propagated via the inner tube 30. The air for combustion at the raised temperature is introduced to the first mixing chamber 71 through the first introduction holes 36. This suppresses liquidation of already evaporated fuel in fuel injected to the inner tube 30 after combustion starts and promotes evaporation of liquidized fuel at that time.

A post-combustion gas heats and expands the head portion 35. The expansion amount in the direction parallel to the central axis AX1 (the axial direction) is greater than the expansion amount in the radial direction. The outer tube 60 is not directly exposed to the post-combustion gas, and the distribution chamber 67 intervenes between the outer tube 60 and the inner tube 30. Moreover, the inner circumferential surface of the outer tube 60 is exposed to air for combustion flowing in the distribution chamber 67. For this reason, the outer tube 60 is maintained at a lower temperature than the head portion 35. For this reason, after combustion starts, the outer tube 60 does not expand, or expands by a small amount. Therefore, a difference occurs in the expansion amount between the inner tube 30 and the outer tube 60.

Figure 4:
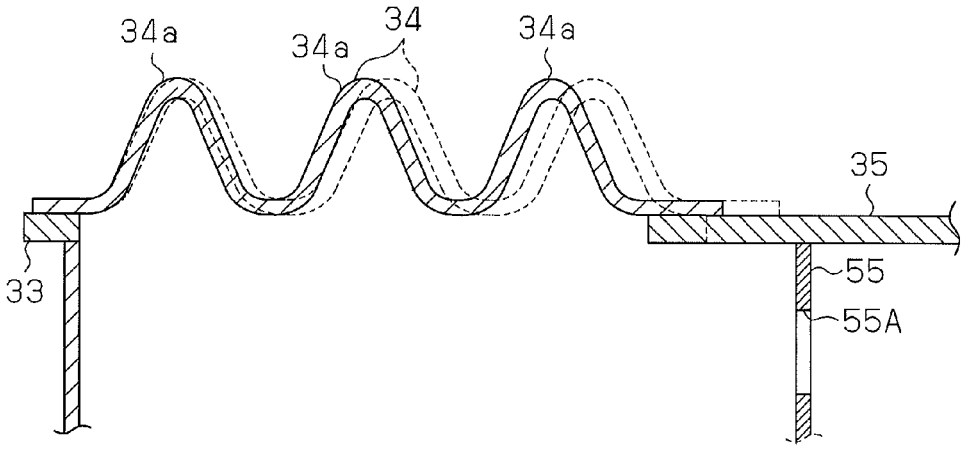
FIG. 4 is an enlarged view of a principal part of the burner in FIG. 1.

As shown in FIG. 4, the head portion 35, which has the distal end fixed to the head-side base 63, extends in the direction opposite to the head-side base 63, that is, toward the extendable portion 34. In FIG. 4, the dashed line illustrates a state before combustion starts. The solid line illustrates a state in that the head portion 35 expands after combustion starts. For example, when the length of the burner 20 is a few hundreds millimeters, the expansion amount of the head portion 35 is in the order of length from a few millimeters to a few over ten millimeters. In FIG. 4, the expansion amount is exaggerated. The extendable portion 34 absorbs expansion of the head portion 35 by being compressed so as to move the raised portions 34*a* closer to each other. The extendable portion 34, which is made from metal, radially expands by heat transferred from the head portion 35. However, the expansion amount is small since the extendable portion 34 absorbs a small amount of heat compared to the head portion 35.

When the difference in the expansion amount between the inner tube 30 and the outer tube 60 is not absorbed, greater stress acts on joining portions between the inner tube 30 and the bases 21, 63, joining portions between the outer tube 60 and the bases 21, 63, or the walls of the inner tube 30 and the outer tube 60. When the burner 20 is repeatedly ignited, the joining portions and the walls are repeatedly stressed. This damages the joining portions, the inner tube 30, and the outer tube 60 from fatigue cracks and the like. In the present embodiment, the extendable portion 34 absorbs the difference in the expansion amount, and reduces an amount of stress applied to the joining portions, the inner tube 30, and the outer tube 60.

As described above, the first embodiment provides the advantages listed below.

(1) Since the inner tube 30 includes the combustion chamber 77 inside, the expansion amount of the inner tube 30 is greater than that of the outer tube 60. The opposite ends of the inner and outer tubes 30, 60 are fixed to the basal-side base 21 and the head-side base 63 respectively. Thus, a difference in the expansion amount between the tubes becomes a factor to cause damage unless cancelled. In the first embodiment, the extendable portion 34 included in the inner tube 30 absorbs the difference in the expansion amount. This reduces stress applied to the inner tube 30 and the outer tube 60 at combustion and suppresses damage on the joining portions, the inner tube 30, and the outer tube 60 from fatigue cracks and the like.

(2) The extendable portion 34, which forms a part of the premixing chamber 73, is not directly exposed to a post-combustion gas and absorbs expansion of the head portion 35. For this reason, compared to when the extendable portion 34 forms the combustion chamber 77, the material and the shape of the extendable portion 34 do not have to have a high heat resistance. Furthermore, when the extendable portion 34 forms the combustion chamber 77, even if the wall includes the second introduction holes 39, the inner diameters of the second introduction holes 39 are changed at contraction. In the first embodiment, where the extendable portion 34 forms the premixing chamber 73, the flexibility in design of the combustion chamber 77 is maintained compared to when the extendable portion 34 forms the combustion chamber 77.

(3) The inner tube 30 includes the raised pieces 37 in the basal portion, and the outer tube 60 includes the guide plate 68. This promotes swirling of air for combustion. The extendable portion 34 includes the circumferential wall extending in the swirling direction of the swirling flow, and the circumferential wall is bellows-shaped. This causes the swirling flow to strike the pleated circumferential wall, thereby generating turbulence. Accordingly, mixture of fuel and air for combustion is promoted.

(4) The inner tube 30 includes the basal portion 33 formed with the raised pieces 37, the head portion 35 including the combustion chamber 77 inside, and the extendable portion 34 arranged between the basal portion 33 and the head portion 35. A swirling flow generated by the raised pieces 37 of the basal portion 33 is supplied to the extendable portion 34. The swirling flow strikes the circumferential wall to generate turbulence in the flow, thereby promoting mixture of fuel and air for combustion. When the head portion 35 expands by heat, the extendable portion 34 absorbs the axial extension amount by being compressed.

(5) The head portion 35 and the extendable portion 34 are cylindrical, and the circumferential wall of the head portion 35 is parallel to the extension direction of the extendable portion 34. For this reason, the direction in which the head portion 35 extends with thermal expansion is the same as the extension direction of the extendable portion 34. This minimizes stress applied to the inner tube, for example, compared to when the head portion 35 of the inner tube are conical.

Second Embodiment

Figure 5:
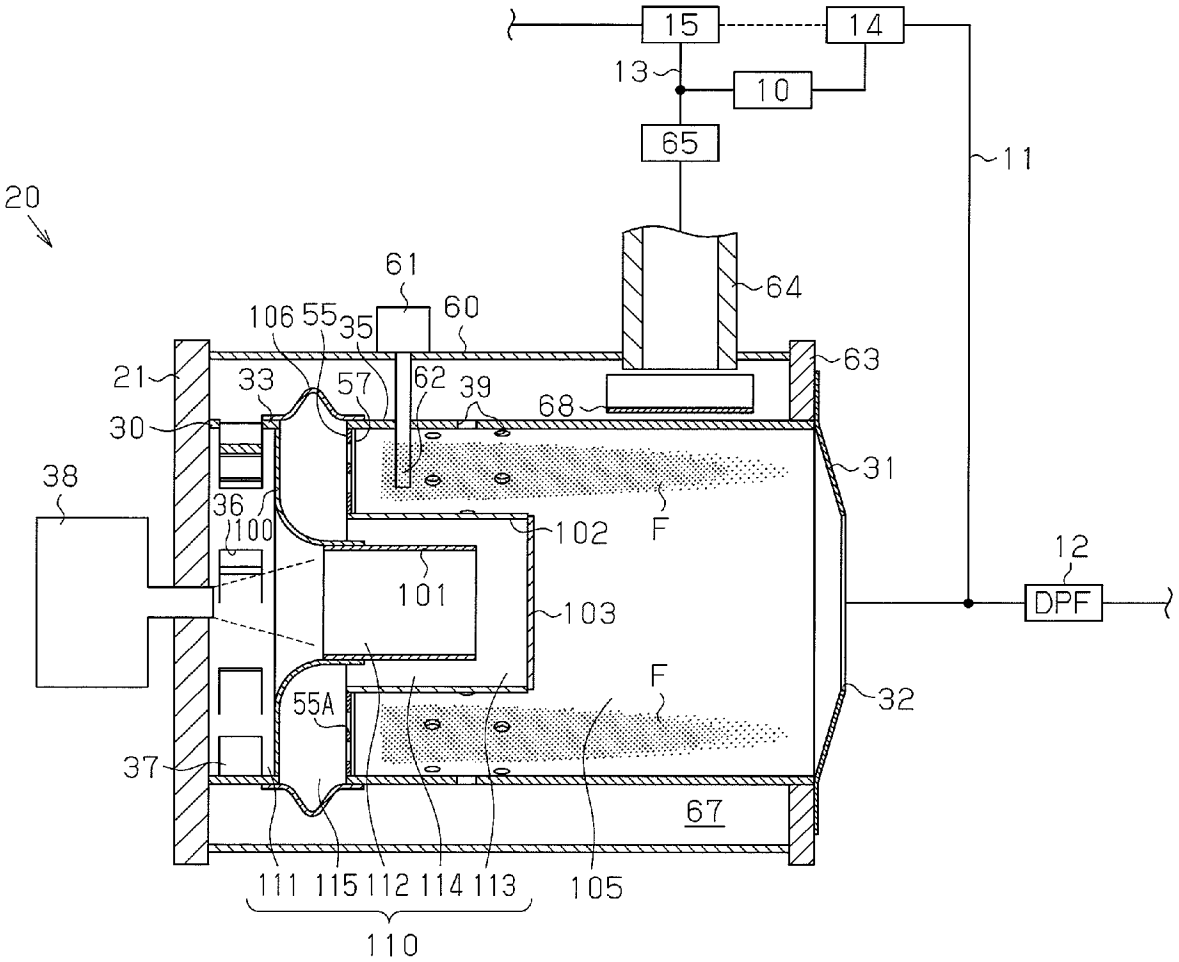
FIG. 5 is a schematic view of a burner for an exhaust gas purification device according to a second embodiment of the present invention.

A burner for an exhaust gas purification device according to a second embodiment of the present invention will now be described with reference to FIG. 5. The burner 20 of the second embodiment only differs from the first embodiment in the premixing chamber of the burner 20. Like or corresponding parts will not be described in detail.

The inner tube 30 and the outer tube 60 are fixed to the basal-side base 21 of the burner 20. The basal and distal ends of the inner tube 30 are fixed to the basal-side base 21 and the head-side base 63 respectively. The basal and distal ends of the outer tube 60 are also fixed to the basal-side base 21 and the head-side base 63 respectively. The ejection plate 31, which has the ejection port 32, is arranged at the distal end of the inner tube 30.

The premixing chamber will now be described. A connecting wall 100 and a burner head 55 are fixed to the inner surface of the inner tube 30. The connecting wall 100 is arranged so as to include a gap between the raised pieces 37 and the burner head 55 in the axial direction of the inner tube 30. The connecting wall 100, the basal-side base 21, and the inner tube 30 define a first mixing chamber 111.

The connecting wall 100 includes an end in the axial-direction, which projects toward the ejection port 32 and includes an insertion opening. A first connecting tube 101 is inserted in the insertion opening. The first connecting tube 101 extends from the connecting wall 100 in the axial direction, and opens toward the ejection port 32. The inner space of the first connecting tube 101 is a second mixing chamber 112. The connecting wall 100 and the first connecting tube 101 form a first connecting tube portion.

The burner head 55 includes a connecting hole formed in the center, and a second connecting tube 102 is fitted into the connecting hole. The burner head 55 and the second connecting tube 102 form a second connecting tube portion. The second connecting tube 102 extends from the burner head 55 toward the ejection port 32 in the axial direction, and the distal end is closed by a closing plate 103. The second connecting tube 102, the closing plate 103, and the opening end of the first connecting tube 101 define a third mixing chamber 113. The inner circumferential surface of the second connecting tube 102 and the outer circumferential surface of the first connecting tube 101 define a fourth mixing chamber 114. The connecting wall 100, the inner tube 30, and the burner head 55 define a fifth mixing chamber 115.

The mixing chambers 111-115 form the premixing chamber 110. The second to fifth mixing chambers 112-115 have flow path cross-sectional areas different from each other. The inner tube 30, the second connecting tube 102, the burner head 55, and the closing plate 103 define a combustion chamber 105.

The circumferential wall of the inner tube 30 includes an extendable portion 106 between the connecting wall 100 and the burner head 55. The opposite ends of the extendable portion 106 are fixed to the head portion 35 and the basal portion 33 of the inner tube 30 respectively. The extendable portion 106 includes one raised portion, and can be extended and contracted in the direction parallel to the axial direction of the inner tube 30.

Operation of the aforementioned burner 20 will now be described. When a regeneration process of the DPF 12 is started, air for combustion flows into the distribution chamber 67. The air for combustion introduced by the guide plate 68 swirls around the inner tube 30.

Some of the air for combustion flowing in the distribution chamber 67 is introduced to the combustion chamber 105 through second introduction holes 39. The remaining portion of the air for combustion is introduced to the first mixing chamber 111 through the first introduction holes 36. Similar to the first embodiment, a swirling flow is generated in the first mixing chamber 111.

In the first mixing chamber 111, the fuel supply unit 38 supplies fuel toward the swirling flow to generate a premixed air-fuel mixture, in which the air for combustion and the fuel are mixed. The premixed air-fuel mixture flows into the second mixing chamber 112 while swirling.

The premixed air-fuel mixture flowing into the second mixing chamber 112 flows toward the ejection port 32, passes through the second mixing chamber 112, turns around in the third mixing chamber 113, flows into the fourth mixing chamber 114, and flows in the direction opposite to the mixing chamber 72. Then, the premixed air-fuel mixture turns around again in the fifth mixing chamber 115, and flows into the combustion chamber 105 through the supply holes 55A of the burner head 55.

The premixing chamber 110 has a longer flow path by the length of the mixing chambers 113-115, and this promotes mixture of the air-fuel mixture. Since the mixing chambers 113-115 have flow path cross-sectional areas different from each other, the rapid change in the flow path cross-sectional area further promotes mixture of the air-fuel mixture.

Ignition of the air-fuel mixture flowing into the combustion chamber 105 generates a flame F, which is an air-fuel mixture during combustion, in the combustion chamber 105, and the flame F generates a combustion gas. Air for combustion is supplied to the flame F through the second introduction holes 39 formed in the inner tube 30.

The combustion gas generated in the combustion chamber 105 is supplied to the exhaust passage 11 through the ejection port 32. The combustion gas heats the premixed air-fuel mixture in the fourth mixing chamber 114 via the second connecting tube 102. This suppresses liquidation of already evaporated fuel and promotes evaporation of non-evaporated fuel.

When the combustion gas is generated in the combustion chamber 105, the combustion gas heats the inner tube 30 including the combustion chamber 105. In the inner tube 30, the head portion 35, which is directly exposed to the post-combustion gas, has the greatest expansion amount, mostly expanding in the axial direction. The outer tube 60 is maintained at a lower temperature than the head portion 35. The head portion 35 of the inner tube 30 expands toward the extendable portion 106. The extendable portion 106 absorbs the expansion by being compressed in the axial direction. At this time, the relative distance between the connecting wall 100 and the burner head 55 is decreased, and the flow path cross-sectional areas of the third mixing chamber 113 and the fifth mixing chamber 115 are slightly decreased not as much as blocking the premixing chamber 110.

As described above, the burner 20 of the above embodiment provides the following advantage in addition to the advantages (1) to (5) described in the first embodiment.

(6) The premixing chamber 110 of the burner 20 has a portion at which the flow path of the premixed air-fuel mixture is turned around. For this reason, the burner 20 has a longer flow path of a premixed air-fuel mixture than a burner including a premixing chamber not having such a turned-around portion. This promotes mixture of air for combustion and fuel, and improves combustion quality of the premixed air-fuel mixture. As a result, the combustion gas contains a less amount of non-combusted fuel. A thermal expansion difference occurs between the outer tube 60 exposed to the air for combustion and the inner tube 30 exposed to the post-combustion gas. However, the extendable portion 106, which is arranged between the connecting wall 100 and the burner head 55 in the inner tube 30, absorbs expansion of the head portion 35 of the inner tube 30.

The embodiments described above may be modified in the forms described below.

Figure 6:
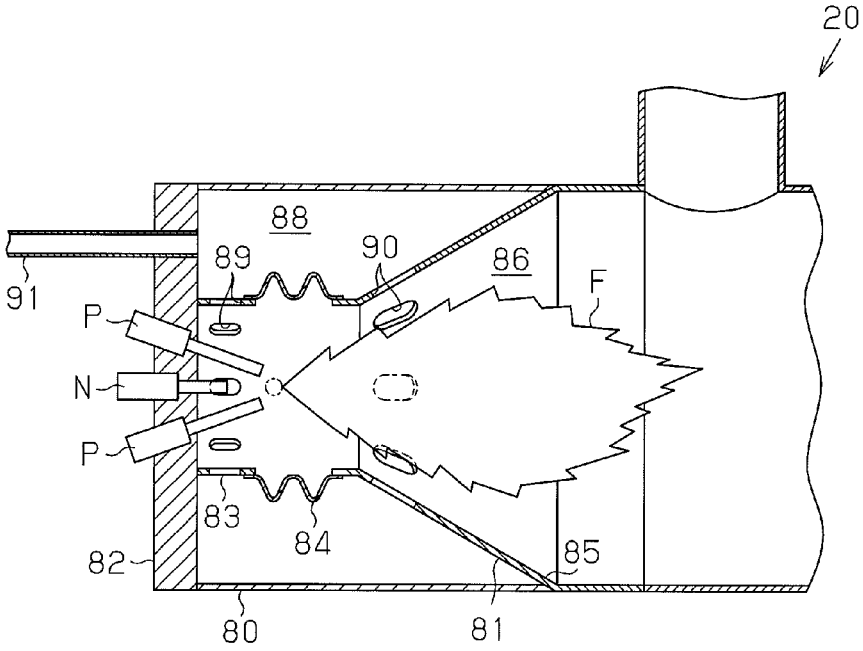
FIG. 6 is a schematic view of a burner for an exhaust gas purification device according to a modification of the present invention.

When the burner 20 including the extendable portion 34 or 106 has a multilayer tube structure, the burner is not necessarily a pre-mixing type as the above embodiments. For example, the burner 20 may be a diffusion combustion type burner. For example, as shown in FIG. 6, the burner 20 includes an outer tube 80 and an inner tube 81. The inner tube 81 includes a basal portion 83 fixed to a base 82, an extendable portion 84 joined to the basal portion 83, and a head portion 85 joined to the extendable portion 84. The basal portion 83 is fixed to the base 82. The head portion 85 is formed conical, and the distal end is joined to the outer tube 80. A fuel injector N and a pair of spark plugs P are fixed to the base 82. An air chamber 88 is arranged between the inner tube 81 and the outer tube 80. Air is supplied to the air chamber 88 through an air supply passage 91 fixed to the base 82. The supplied air is supplied to the inside of the inner tube 81 through air holes 89 formed in the inner tube 81 and air holes 90 formed in the head portion 85. When the fuel injector N injects fuel and the spark plugs P ignite the fuel, a flame F occurs in the combustion chamber 86 and heats the inner tube 81 to a high temperature. The outer tube 80 is maintained at a relatively low temperature. The extendable portion 84 absorbs thermal expansion of the inner tube 81.

In the above embodiments, the extendable portion is bellows-shaped, but may be made from a metal foil and shaped cylindrical. The cylinder made from the metal foil bends with wrinkles when the head portion 35 expands with heat. When extinction of fire cools the head portion 35, the cylinder is stretched by force that the head portion 35 pulls. The raised portions are not necessarily lined up in a regular manner like bellows, and may be formed in an irregular manner.

In the first embodiment, the extendable portion 34 includes a plurality of raised portions 34*a*, but may have only one raised portion 34*a*.

In the above embodiments, the extendable portion 34, 106 forms a part of the premixing chamber 73, 110, but may form the combustion chamber 77, 105. When forming the combustion chamber 77, 105, the inner tube 30 includes the basal portion, the central portion forming the premixing chamber, and the extendable portion in the order of the basal portion, the central portion, and the extendable portion from the base 21. Even in this case, the extendable portion absorbs the own expansion when heat of a post-combustion gas expands the extendable portion.

The above embodiments fix the opposite ends of the inner and outer tubes 30, 60 to the bases 21 and 63, respectively, but the basal or distal end of the inner tube 30 may be fixed to the inner circumferential surface of the outer tube 60. Alternatively, the opposite ends of the inner and outer tubes 30, 60 may be fixed to external members other than the bases 21 and 63.

In the above embodiments, the first tube having the combustion chamber 77, 105 is located radially inside of the second tube, but the first tube may be located radially outside of the second tube. For example, a second tube shorter in the axial direction may be arranged radially inside of a first tube. The first tube may have a combustion chamber close to the outlet of the second tube.

The burner 20 may only have either the raised pieces, which form the swirling flow generating portion, or the guide plate. Alternatively, the burner 20 may have neither of these.

The burner 20 may be constructed without the basal portion 33 in the above embodiments.

In the above embodiments, the head portion of the inner tube 30 may be shaped conical, not limited to cylindrical. In this case, as long as the extendable portion is capable of absorbing expansion of the head portion, the extendable portion may have a conical or cylindrical shape continuous with the head portion.

In the first embodiment, the burner 20 has a dual tube structure formed with an inner tube and an outer tube, and in the second embodiment, the burner 20 has a quadruple tube structure. As substitute for these structures, the burner 20 may have a triple tube structure, or a structure with five or more tubes.

The air supply port 60A may be formed in an area other than the area close to the head portion of the outer tube 60. For example, the air supply port 60A may be formed in a central portion. A plurality of air supply ports 60A may be formed.

In the above embodiments, the swirling flow generating portion is formed by the raised pieces 37, which are cut and raised inward. However, the raised pieces 37 may have different shapes, such as swirlers formed on the outer circumference of the inner tube 30.

In the second embodiment, the extendable portion 106 is located between the connecting wall 100 and the burner head 55 in the inner tube 30, but may be located in the head portion. If the basal portion including the raised pieces 37 has a space for further forming the extendable portion 106, the extendable portion 106 may be formed in the basal portion.

In the above embodiments, the fuel supply unit 38 is a type of device that evaporates fuel inside, but may be a type of device that sprays liquid fuel into the inner tube 30.

The ignition portion 62 may include a glow plug, a laser spark device, and a plasma spark device in addition to the spark plug as necessary. If the ignition portion 62 can generates a flame F, the ignition portion 62 may include only one of the glow plug, the laser spark device, and the plasma spark device.

Not limited to intake air flowing through the intake passage 13, air for combustion may be air flowing through a pipe connected to a brake air tank or air supplied from a blower for the burner for an exhaust gas purification device.

Not limited to the DPF 12, the exhaust gas purification device may be a device including a catalyst for purifying an exhaust gas. In this case, the burner 20 raises the temperature of the catalyst and therefore, the temperature promptly rises to the activation temperature.

The engine including the burner for an exhaust gas purification device may be a gasoline engine.

DESCRIPTION OF THE REFERENCE NUMERALS

20: burner for an exhaust gas purification device; 30: inner tube as a first tube; 32: ejection port as a discharge port; 33, 83: basal portion; 34, 84, 106: extendable portion; 35, 85: head portion; 37: raised pieces forming a swirling flow generating portion; 60: outer tube as a second tube; 68: guide plate forming the swirling flow generating portion; 73: premixing chamber; 77, 86: combustion chamber; and AX1: central axis.

What is claimed is:

1. A burner for an exhaust gas purification device comprising:

a base unit;

a first tube, which includes:

a basal portion and a distal portion;

a combustion chamber; and a discharge port for discharging a post-combustion gas, wherein the basal portion and the distal portion are fixed to the base unit; and a second tube, which includes a basal portion and a distal portion, wherein the basal portion and the distal portion are fixed to the base unit, wherein the first tube includes an extendable portion that can be extended and contracted in a direction parallel to a central axis of the first tube, and the first tube and the second tube are radially overlapped to have a multilayer tube structure, wherein at least one of the first tube and the second tube further includes a swirling flow generating portion, and the extendable portion includes a circumferential wall, which extends in a swirling direction of a swirling flow and is bellows-shaped.

2. The burner for an exhaust gas purification device according to claim 1, further comprising a premixing chamber, which is arranged upstream of the combustion chamber and configured to supply a premixed air-fuel mixture, in which air for combustion and fuel are mixed, to the combustion chamber, wherein the extendable portion forms a part of the premixing chamber.

3. The burner for an exhaust gas purification device according to claim 1, wherein the basal portion of the first tube includes raised pieces for generating a swirling flow in the first tube, and the first tube further includes a head portion having the combustion chamber inside, and the extendable portion is arranged between the basal portion and the head portion.

4. The burner for an exhaust gas purification device according to claim 1, wherein the first tube further includes a head portion having the combustion chamber inside, and the extendable portion is joined to the head portion, and the head portion and the extendable portion are shaped cylindrical, and the extendable portion is joined to the head portion such that an extension direction of the extendable portion is parallel to a circumferential wall of the head portion.

5. A burner for an exhaust gas purification device comprising:

a base unit;

a first tube, which includes:

a basal portion and a distal portion;

a combustion chamber; and a discharge port for discharging a post-combustion gas, wherein the basal portion and the distal portion are fixed to the base unit; and a second tube, which includes a basal portion and a distal portion, wherein the basal portion and the distal portion are fixed to the base unit, wherein the first tube includes an extendable portion that can be extended and contracted in a direction parallel to a central axis of the first tube, and the first tube and the second tube are radially overlapped to have a multilayer tube structure, wherein the second tube is located radially outside of the first tube, and a flow path for air for combustion is formed between the first tube and the second tube, the burner for an exhaust gas purification device further comprising:

a first connecting tube portion connected to an inner circumferential surface of the first tube and including an opening at an end closer to the discharge port; and a second connecting tube portion including a lid portion and compartmentalizing the combustion chamber from a premixing chamber, the second connecting tube portion including a supply hole connected to the combustion chamber, wherein the first connecting tube portion is inserted in the second connecting tube portion while being spaced from the second connecting tube portion, and the extendable portion is formed in a part of a circumferential wall of the first tube and is arranged between the first connecting tube portion and the second connecting tube portion.

* * * * *